United States Patent [19]

Tokuno et al.

[11] 4,420,998

[45] Dec. 20, 1983

[54] DIE CUTTER AND DIE-CUTTING PROCESS

[75] Inventors: Masateru Tokuno, Nishinomiya; Tetsuya Sawada, Kyoto, both of Japan

[73] Assignee: Rengo Co., Ltd., Osaka, Japan

[21] Appl. No.: 372,240

[22] Filed: Apr. 26, 1982

[30] Foreign Application Priority Data

May 29, 1981 [JP] Japan ..... 56-84047

[51] Int. Cl.[3] ..... B26D 1/58

[52] U.S. Cl. ..... 83/328; 83/37; 83/313; 83/325; 83/284

[58] Field of Search ..... 83/284, 313, 323, 325, 83/328, 37

[56] References Cited

U.S. PATENT DOCUMENTS

| | | | |
|---|---|---|---|
| 2,394,534 | 2/1946 | Conner | 83/328 |
| 3,057,241 | 10/1962 | Chambon | 83/646 X |
| 3,686,987 | 8/1972 | Colinet et al. | 83/37 |
| 3,765,286 | 10/1973 | Vossen | 83/284 |
| 3,998,119 | 12/1976 | Schröter | 83/328 |

*Primary Examiner*—Donald R. Schran

*Attorney, Agent, or Firm*—Wenderoth, Lind & Ponack

[57] ABSTRACT

An improved die cutter is proposed in which the blanks are supported for a certain amount of movement with respect to the blank gripper so as to be fed not clamped by the gripper but by engagement with the blade and the anvil during the die-cutting. This eliminates the problem resulting from the difference between the blank feed speed and the horizontal component of speed of the blade and the anvil.

4 Claims, 15 Drawing Figures

DIE CUTTER AND DIE-CUTTING PROCESS

The present invention relates to process and apparatus for die-cutting blanks of corrugated fiberboard, cardboard, metal, plastic material or the like into a desired shape.

For corrugated fiberboard, two types of die cutters are known, i.e. rotary types for continuous die-cutting and flat plate types for intermittent die-cutting. The former provides high productivity because of continuous operation, but has a poor cutting accuracy due to slip between the blank and the cutter. Further, it is complicated and expensive to mount blades on a rotary blade. The latter provides high cutting accuracy and easy blade mounting on a flat plate. However, the productivity is low because of intermittent operation and the blade is liable to get marred because of greater cutting resistance.

A die cutter is known (e.g. from our Japanese Patent Publication 56-16039) which uses a blade in the form of a flat plate, but die-cuts the blanks continuously. Its operation is schematically illustrated in FIGS. 1A to 1C. A flat plate shaped blade unit 1 comprising a blade and a blade mount is opposed to a flat plate shaped anvil 2 with the blank B supplied therebetween. They have their front ends pivotally supported on driving links 4 and 5 and have their rear ends pivotally and slidably supported on driven links 4' and 5'. The upper surface of the anvil 2 facing the blade is slightly convex.

As shown in FIG. 1B, the link 4 for the blade unit 1 lags by an angle $\theta$ against the vertical line l whereas the link 4' leads by the same angle. This is true for the links 5, 5' for the anvil 2, too. When the links 4, 4' are rotated in the same one direction and the links 5, 5' are rotated in the opposite direction, all at the same angular speed, the contact point between the blade unit and the anvil will shift from one end to the other as shown in FIGS. 1A to 1C. Therefore, a cutting unit including the blade unit 1 and the anvil 2 die-cuts one blank into a desired shape during one cycle of its operation.

If the links 4 and 5 lead whereas the links 4' and 5' lag, the contact point will shift in the opposite direction to above. Also, the blade unit 1 and the anvil 2 may have their front end pivotally and slidably supported on the driven links 4 and 5 and their rear end pivotally supported on the driving links 4' and 5'. Thus, a total of four combinations are possible according to which links are adapted to lead and which links are at the driving side. In any of the combinations, the cutting unit can cut one blank during its one cycle of operation.

With such a known die cutter, the cutting accuracy is not entirely satisfactory due to the fact that the angular speed of the links 4 and 5 at the driving side is constant, but the horizontal component ($V_1$, $V_2$ and $V_3$) of the peripheral speed at the tip of the links varies as shown in FIG. 2. The curve S shows that as is known, the horizongal component varies substantially according to the cosine curve. So does the speed of the blade unit 1 and the anvil 2 whereas the blank speed is constant. Thus, the horizontal component of the speed of the blade unit 1 and the anvil 2 does not coincide with the blank speed. If the radius of rotation of the links is large or the blanks are thin, the difference in these two speeds does not offer a problem, though the cutting accuracy is not satisfactory.

If blanks not so thin are die-cut without correcting such a difference in speed, they might be torn or get damaged and the blade might be nicked. Further, the blanks would not be die-cut to the desired shape.

In order to solve this problem, various methods are possible by which the blank feed speed during die-cutting is mechanically or electrically brought into agreement with the speed of the blade unit and the anvil. However, these methods require rather complicated devices.

An object of the present invention is to provide a process and apparatus for die-cutting blanks in which the blank speed can be brought into agreement with the horizontal component of the speed of the blade unit and the anvil more easily without the necessity of complicated devices or arrangements.

In accordance with the present invention, this object is accomplished by permitting the blank some amount of movement with respect to the blank feed unit during the die-cutting to absorb the abovementioned difference in speed.

FIG. 3 shows a basic concept of the present invention. In accordance with one aspect of the present invention, the blank grip unit clamping the blank is allowed to move with respect to the blank feed unit within a small distance $\Delta X$ during the die-cutting. In another aspect of the present invention, the blank itself is allowed to move with respect to the blank grip unit fixedly mounted on the blank feed unit within a small distance $\Delta Y$ during the die-cutting.

Other features and advantages of the present invention will become apparent from the following description taken with reference to the accompanying drawings, in which.

The preferred embodiment will be described in more detail with reference to FIGS. 4 to 12. In the following description, the word "front" refers to the blank discharge side (left on FIG. 4) and the word "rear" refers to the blank supply side (right on FIG. 4).

Figure 4:
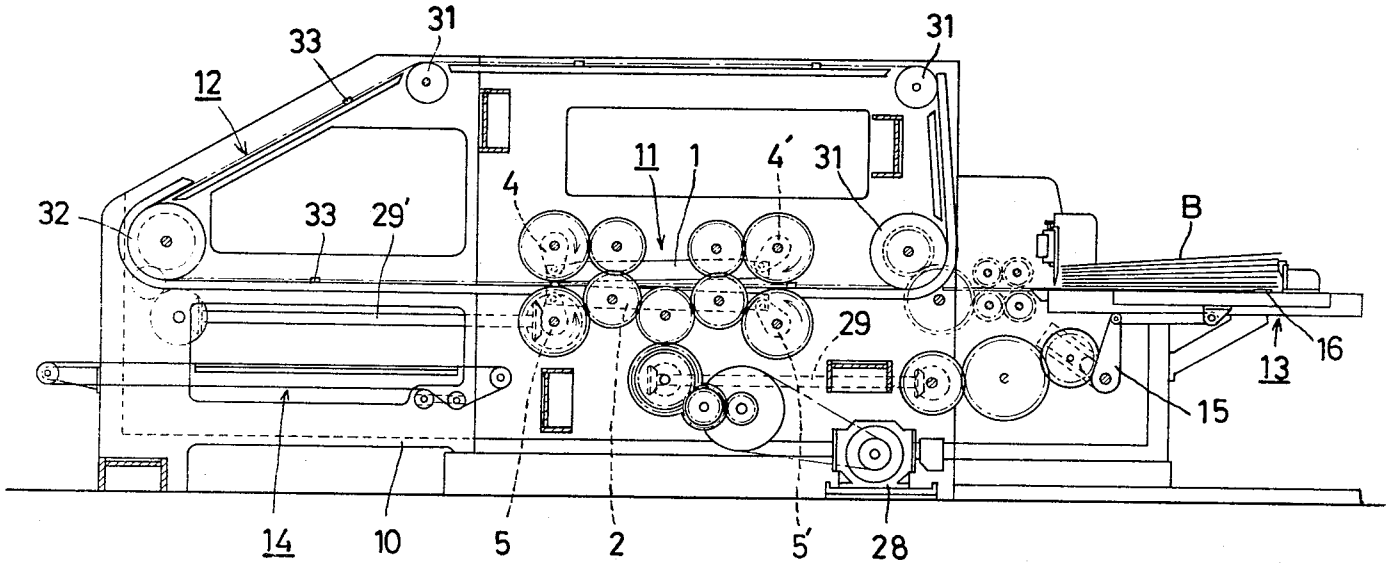
FIG. 4 is a vertical sectional view of the entire die cutter embodying the present invention.

FIG. 4 illustrates an entire die cutter embodying the present invention which includes a frame 10, a cutting unit 11, a blank feed unit 12, a blank supply unit 13, a blank discharge unit 14, and a drive unit 28.

The blank supply unit 13 provided behind the cutting unit 11 has a kicker 16 adapted to reciprocate by means of a crank arm 15. It operates in synchronization with the blank feed unit 12 to supply blanks B thereto intermittently one after another. The blank discharge unit 14 comprises a belt conveyor provided in front of the cutting unit 11 to discharge the die-cut blanks which have fallen from the blank feed unit 12.

Figure 1A:
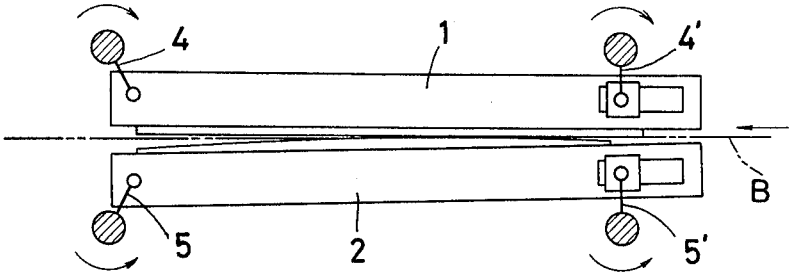
FIG.1A (PRIOR ART)
FIGS. 1A to 1C are schematic views showing how the conventional die cutter operates.
Figure 1B:
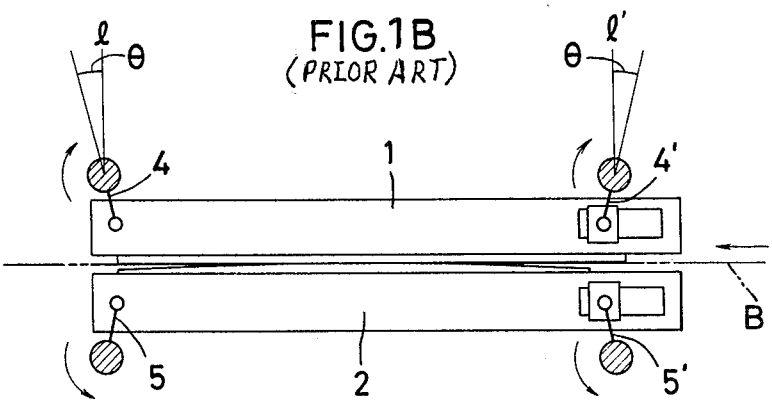
FIG.1B (PRIOR ART)
Figure 1C:
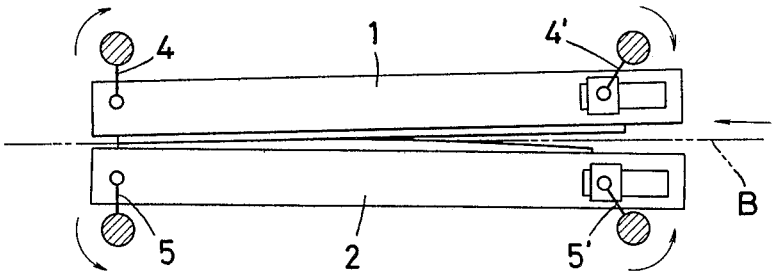
FIG.1C (PRIOR ART)
Figure 5:
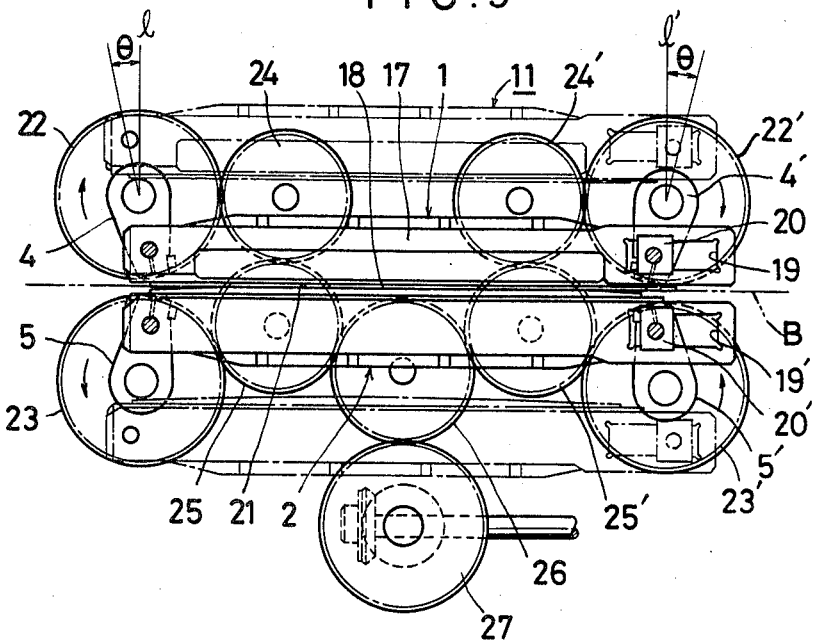
FIG. 5 is a vertical sectional side view of the cutting unit.
Figure 6:
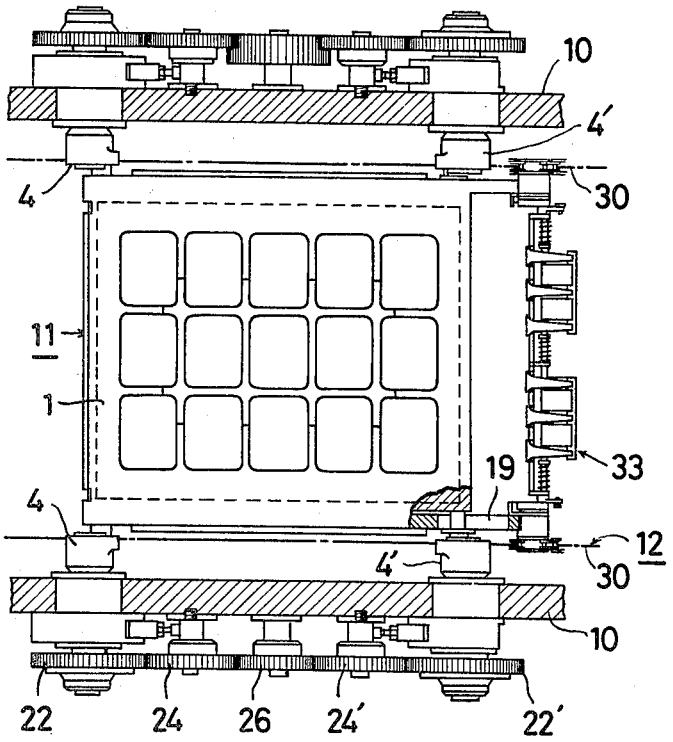
FIG. 6 is a plan view of the same.
Figure 7:
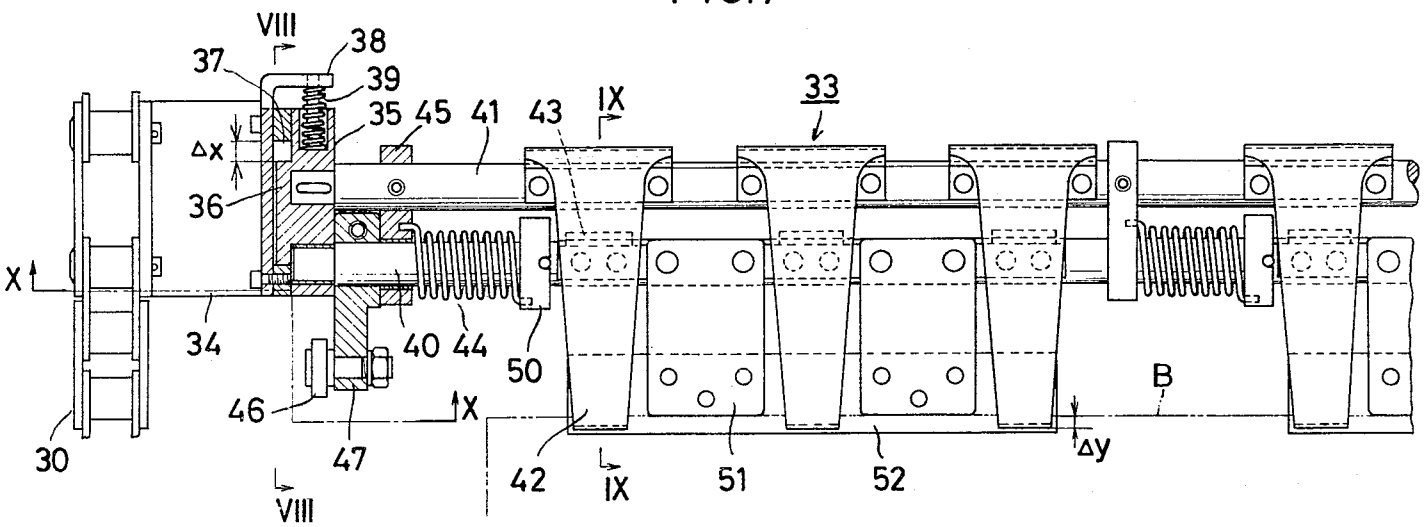
FIG. 7 is a partial plan view of the blank grip unit.
Figure 8:
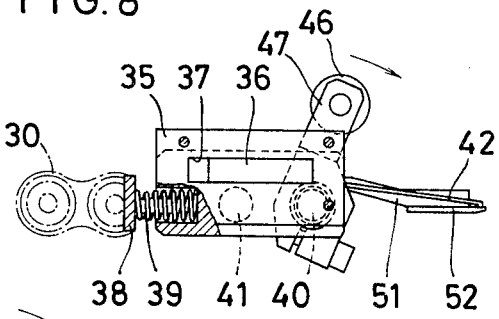
FIG. 8 is a sectional view taken along the line VIII—VIII of FIG. 7.

As shown in FIGS. 5 and 6, the cutting unit 11 includes a blade unit 1 shaped like a flat plate and an anvil 2 of a similar shape opposed thereto with the blanks supplied therebetween. The blade unit and the anvil have their front and rear ends pivotally supported on links 4, 4, and 5, 5', respectively. This is the same as the known arrangement shown in FIGS. 1A to 1C.

As will be seen from FIG. 5, the blade unit 1 has a flat blade mount 17 and a blade 18 removably mounted on the underside of the blade mount. The blade mount is provided with a guide slot 19 at its rear end of each side to receive a slider 20 therein. The rear links 4' are pivotally mounted on the sliders 20. The anvil 2 is of a shape similar to the blade unit with guide slots 19' receiving sliders 20'. Its upper surface 21 facing to the blade is slightly convex.

The links 4, 4', 5 and 5' have the same radius of rotation and are fixedly mounted on the shafts of gears 22, 22', 23, 23', respectively, which have the same diameter and the same number of teeth and are driven by a driving gear 27 through idle gears 24, 24', 25, 25' and 26. Thus, the links 4, 4' for the blade unit turn in the same one direction indicated by arrow and the links 5, 5' for the anvil turn in the reverse direction.

In the condition shown in FIG. 5, the front links 4 for the blade unit lag by an angle $\theta$ against the vertical line l whereas the rear links 4' lead by the same angle. Thus, there is a phase difference of $2\theta$ between the links 4 and 4'. There is a similar phase difference between the links 5, 5' for the anvil 2, too.

Since the blade unit 1 and the anvil 2 are driven by the links 4, 4', 5 and 5' so arranged and the anvil has a suitably convex upper surface 21, the blade unit and the the anvil will turn with the blade 18 contacting the convex surface 21 of the anvil at a point, said contact point moving from one end to the other (from rear to front in the preferred embodiment). As a result, the blanks B are die-cut into a desired shape. The blade 18 may be provided to extend for almost the whole length of the blade mount 17 or for only part thereof.

Next, the blank feed unit 12 will be described. It has two endless chains 30 running at a constant speed inside of the frame 10 (FIG. 6) around a plurality of guide sprockets 31 and a drive sprocket 32 (FIG. 4). Blank grip units 33 are provided so as to extend between two chains 30 at fixed intervals (FIGS. 4 and 6).

Referring to FIGS. 7–10, each grip unit 33 includes a bracket 34 fixed to a chain 30 at each side of the die cutter, and a slide block 35 mounted on the bracket 34 so as to be slidable in the chain running direction. The slide block 35 is formed with a guide plate 36 projecting from its side. The guide plate is disposed in a groove 37 formed in the bracket 34 so as to be movable within a small distance or range $\Delta X$ which is sufficiently long to absorb the difference between the speed of the blank feed unit and the horizontal component of the speed of the blade unit 1 and the anvil 2 during the die-cutting. The bracket 34 is provided with an arm 38 at its front end. A spring 39 is held between the arm 38 and the slide block 35 to urge the slide block rearwardly.

Two bars 40, 41 are mounted on the slide blocks 35 so as to extend therebetween. The rear bar 40 is rotatably mounted and the front bar 41 is unrotatably mounted. A plurality of grip pieces 42, which are plate springs, are fixed to the front bar 41 with spacings.

Figure 9:
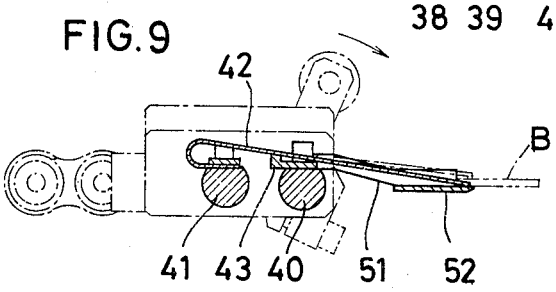
FIG. 9 is a sectional view taken along the line IX—IX of FIG. 7.
Figure 10:
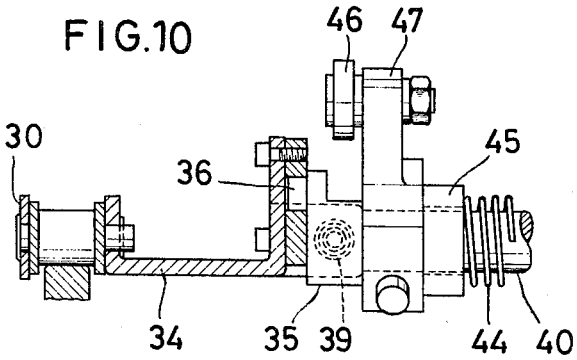
FIG. 10 is a sectional view taken along the line X—X of FIG. 7.

Each grip piece 42 is curved at a point adjacent to its fixed end and its free end extends rearwardly over the rotatable bar 40 (FIG. 9). The grip piece is elastically supported at it middle portion by a grip support 43 secured to the rotatable bar 40. A plurality of grip pieces 42 are provided in several groups. In the embodiment, there are two groups each including three grip pieces. (FIG. 6) For each group, a spring support 45 for a spring 44 for returning the rotatable bar 40 is fixedly mounted on the bar 41. The bar 40 rotatably extends through the spring supports 45.

A support arm 47 carrying a cam roller 46 is mounted on the rotatable bar 40 at each end thereof at an adjustable angle so that the bar will turn when the cam roller 46 is engaged by cam plates 54, 56 which will be described later. Each return spring 44 mounted on the rotatable bar 40 is held between the spring support 45 and an engaging member 50 fixedly mounted on the bar 40.

A plurality of support plates 51 are fixedly mounted on the rotatable bar 40, each between the adjoining ones of the grip supports 43. The support plates 51 each carry a grip piece 52 at their tip, said pieces 52 cooperating with the grip pieces 42 on the front bar 41 to clamp the blank B therebetween with the resilience of the grip pieces 42. The rear end surface of each support plate 51 forms an abutment surface against which the blank abuts when clamped. (FIG. 9)

Since the grip unit 33 is kept biassed rearwardly by the spring 39 provided at each end thereof in the slide block 35, its position is stable inspite of the presence of the abovementioned range or distance $\Delta X$ for free movement. The grip unit 33 does not vary in position with respect to the chain 30 except during the die-cutting. The die-cutting position for each blank is stable due to the fact that the blanks are butt against the rear end surface of the support plates 51 and that the position of the grip unit itself is stable.

Figure 11:
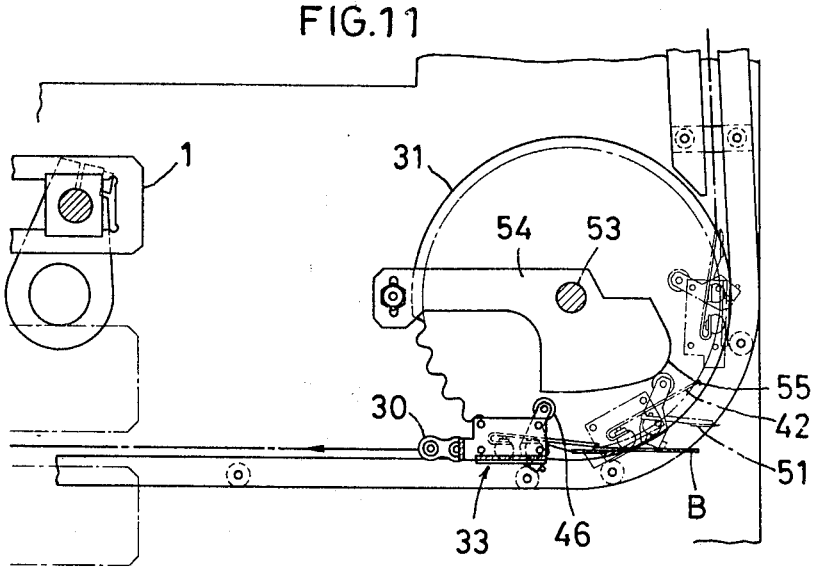
FIG. 11 is a side view of a portion of the blank feed unit showing how the blank is clamped.

Referring to FIG. 11, a cam plate 54 having a curved surface 55 is mounted on the shaft 53 of each guide sprocket 31 at each side at an adjustable angle. When the cam roller 46 is engaged by the cam plate 54 at its curved surface 55, the bar 40 will turn in the direction of arrow shown in FIGS. 8 and 9. Simultaneously, the support plates 51 and the grip pieces 52 turn in the same direction and the grip pieces 42 are pushed up by the grip support 43 so that the grip pieces 42 and 52 will be in their open position shown in FIG. 11 by dotted line. The blank B is supplied into the open space thus formed between the grip pieces 42 and 52. When the cam roller 46 comes off the curved surface 55, the bar return springs 44 cause the bar 40 to turn back to its original position so that the blank will be clamped between the grip pieces 42, 52.

Figure 12:
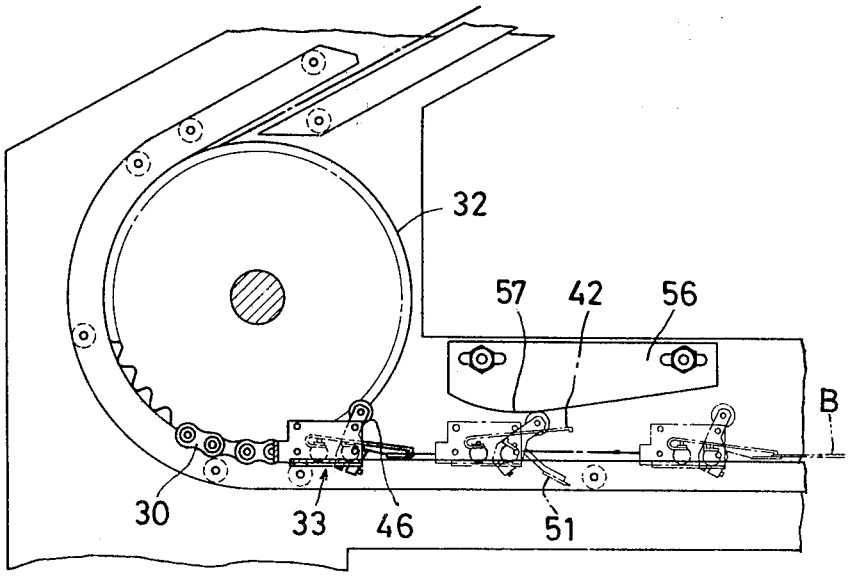
FIG. 12 is a side view of another portion of the blank feed unit showing how the blank is released.

Referring to FIG. 12, a cam plate 56 having a curved surface 57 is provided at rear of the drive sprocket 32 at each side of the cutter. When the cam roller 46 is engaged by the curved surface 57, the grip pieces 42 will be brought away from the grip pieces 52, letting the blank to fall on to the blank discharge unit 14.

The cutting unit 11, the blank feed unit 12 and the blank supply unit 13 are driven from a common drive unit 28 (FIG. 4) through chain and gear transmission and transmission shafts 29, 29' so as to synchronize the blank supply, blank feed and die-cutting with one another.

Figure 2:
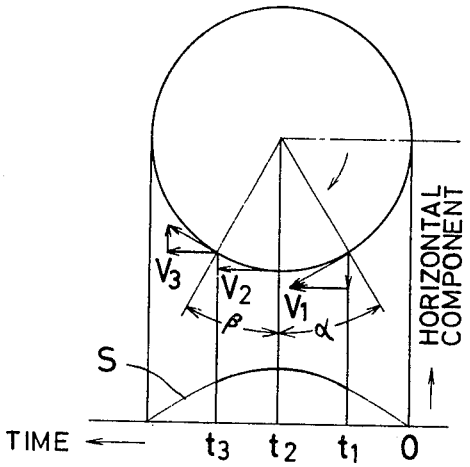
FIG. 2 (PRIOR ART)
FIG. 2 is a diagram showing the speed vector of the links.
Figure 3:
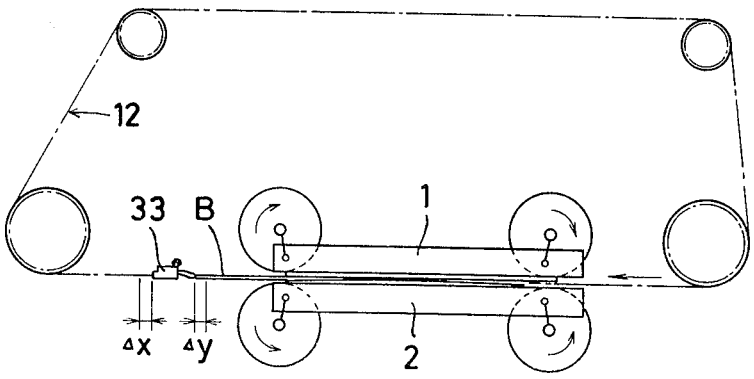
FIG. 3 is a view showing a basic concept of the present invention.

As will be seen from FIG. 2, the horizontal component of the speed of the blade unit 1 and the anvil 2 gradually increases from $V_1$ at time $t_1$ when the die-cutting starts, reaches the highest speed $V_2$ at time $t_2$, and gradually decreases to $V_3$ at time $t_3$ when the die-cutting ends.

If the blank speed, that is, the speed of the blank feed unit 12 is preset to $V_1$ which is the horizontal component at the start of die-cutting, the horizontal component of speed of the blade unit 1 and the anvil 2 is higher than the speed of the blank feed unit 12 during the first half $\alpha$ of the die-cutting. Since the blank B is engaged by and between the blade unit 1 and the anvil 2 during the die-cutting, the blank will push the grip unit 33 forward against the bias of the spring 39 within the abovementioned small range $\Delta X$. In other words, the blade unit 1 and the anvil 2 push the grip unit 33 through the blank against the bias of the spring 39 because the horizontal component of their speed is higher than the speed of the blank feed unit 30 during the die-cutting. The spring 39 absorbs the difference between the blank speed (that is, the speed of the blank feed unit) and the horizontal component of speed of the blade unit and the anvil.

During the latter half $\beta$ of the die-cutting, too, the grip unit 33 is forced to forward for a certain small distance with respect to the blank feed unit because the blank is still engaged by the blade and the anvil. The lengths of the period of time for the first and latter halves depend on the thickness of the blank, the curvature of the upper surface 21 of the anvil 2, and at which side the blade unit and the anvil are driven.

When the die-cutting is complete, the blank is released from the engagement by the blade and the anvil so that the grip unit 33 will get back to its original position under the resilience of the spring 39. The spring functions to limit the movement of the slide block 35 and thus of the grip unit with respect to the blank feed unit as well as to bring them back to their original position after their forced movement. For this purpose, it is necessary to determine the spring constant of the spring 39 suitably.

As will be understood from the foregoing, the blank is fed by the blank feed unit 12 with its front edge clamped by the grip unit 33 until the die-cutting starts. During the die-cutting, the blank is engaged by the blade and the anvil, pushing the grip unit 33 forward against the bias of the spring 39 because the speed of the blade and the anvil is higher than that of the blank feed unit. Therefore, even though the speed of the blank feed unit is not equal to the horizontal component of speed of the blade unit and the anvil during the die-cutting, this does not offer any problem because the grip unit is not fixed but movable with respect to the blank feed unit.

Figure 13:
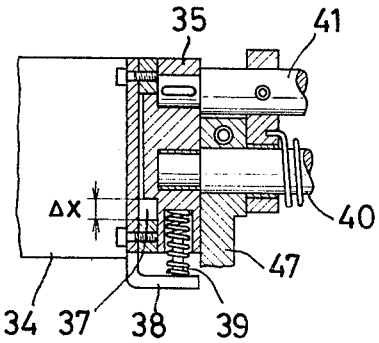
FIG. 13 is a partial plan view of a variant of the blank grip unit.

Although in the abovementioned embodiment the speed of the blank feed unit 12 was preset to $V_1$ which is the horizontal component of speed of the blade unit and the anvil at time $t_1$ at the start of the die-cutting, it may be preset to $V_2$ at time $t_2$ when the horizontal component is the highest. In such a case, the spring 39 and the small range $\Delta X$ are provided at rear of the slide block 35 as shown in FIG. 13, instead of at front thereof as in the first embodiment. During the first half of the die-cutting, the horizontal component of speed of the blade unit and the anvil is lower than the speed of the blank feed unit 12. Thus, the grip unit 33 is pulled by the blank which is engaged by the blade and the anvil, thus moving backward within the small range $\Delta X$, while compressing the spring 39. By this movement, the difference in speed is absorbed as in the first embodiment.

This second embodiment can be used even though the blanks are not so rigid or tough, because only a pulling force acts on the blanks. In contrast, the first embodiment requires that the blank is not so pliable or flexible because the blank has to push the grip unit without deforming. It can be applied for corrugated fiberboard, for example.

The spring 39 may be replaced with an elastic member such as rubber.

The blank grip unit 33 may be replaced with any other known support arrangement, e.g. a pin feed type in which the blank is pinned by a plurality of pins or spikes.

Although in these two embodiments the grip unit 33 clamping the blank is allowed to move with respect to the blank feed unit 12, it may be fixed with respect to that unit and instead the blank may be adapted to be movable with respect to the grip unit within a small distance $\Delta$ (FIG. 7) by suitably selecting the clamping force between the grip pieces 42 and 52. By such an arrangement, the blank can slide or slip between the grip pieces 42 and 52 to absorb any difference between the speed of the blank feed unit and the horizontal component of speed of the blade unit and the anvil. In other words, the arrangement may be such that during the die-cutting the blank is fed with the blade and the anvil, not by the grip unit because the clamping force by the grip pieces 42 and 52 is preset to be smaller than the force of engagement with the blade and the anvil.

Although in any of the above-mentioned embodiments the blanks are clamped between the grip pieces during the die-cutting, it may be released from the grip unit almost at the same time as the start of the die-cutting by means of the blank release mechanism shown in FIG. 12. In this case, the blanks are fed only by engagement with the blade and the anvil during the die-cutting and thereafter they are let to fall on to the conveyor of the blank discharge unit.

It will be understood from the foregoing that in accordance with the present invention the blank is supported with a certain limited amount of movement permitted with respect to the blank feed unit to absorb the difference between the speed of the blank feed unit and the horizontal component of speed of the blade unit and the anvil. By this arrangement, high cutting accuracy can be assured.

What we claim are:

1. A die cutter for die-cutting blanks supplied one after another into a desired shape, said die cutter comprising a cutting means having a blade and an anvil opposed to each other with said blanks supplied to therebetween and link and transmission means for driving said blade and said anvil interlocked with each other in such a manner that they will contact each other at a point moving from one end thereof to the other, said anvil having a surface facing to the blade shaped to be convex; and a blank feed means having a pair of endless conveyors provided one at each side of the die cutter, and a plurality of blank support units transversely mounted on and between said conveyors for feeding said blanks through said cutting means, characterised in that said blanks are supported for a limited amount of movement with respect to said blank feed means so that during the die-cutting said blanks will be fed by their engagement with said blade and said anvil, not by said blank feed means.

2. The die-cutter as claimed in claim 1 wherein said blank support units are mounted on said endless conveyors so as to be displaceable with respect to said endless conveyor within a predetermined range.

3. The die-cutter as claimed in claim 1 wherein said blanks are held by said blank support units so as to be displaceable with respect to said endless conveyors within a predetermined range whereas said blank support units are fixedly mounted on said endless conveyors.

4. The die-cutter as claimed in claim 2 wherein each of said blank support units is mounted on said endlesss conveyors through a pair of slide blocks, each of said slide blocks being urged by an elastic member forwardly or rearwardly.

* * * * *